United States Patent [19]

French

[11] 4,418,437

[45] Dec. 6, 1983

[54] PIPE CLEANING APPARATUS

[76] Inventor: James R. French, Hornerthorpe, Butt La., Great Yarmouth, Norfolk, England

[21] Appl. No.: 355,192

[22] Filed: Mar. 5, 1982

[30] Foreign Application Priority Data

Mar. 12, 1981 [GB] United Kingdom ..... 8107823

[51] Int. Cl.[3] ..... B08B 9/04

[52] U.S. Cl. ..... 15/104.09; 15/104.12

[58] Field of Search ..... 15/104.09, 104.05, 104.3 R, 15/104.12, 104.13, 104.14; 254/134.5; 104/138 G

[56] References Cited

U.S. PATENT DOCUMENTS

| | | | |
|---|---|---|---|
| 2,604,521 | 7/1952 | Boucher | 15/104.05 X |
| 3,078,823 | 2/1963 | Cummings et al. | 15/104.09 X |
| 3,099,227 | 7/1963 | Bryan | 104/138 G |
| 4,369,713 | 1/1983 | Richardson | 104/138 G |

*Primary Examiner*—Edward L. Roberts

*Attorney, Agent, or Firm*—Fleit, Jacobson, Cohn & Price

[57] ABSTRACT

Apparatus for cleaning the bore of a pipe comprising a cleaning tool motor having a housing and a drive shaft which extends from the housing and which is adapted to receive a pipe cleaning tool rotatable with the drive shaft, three guide wheels, which are supported by arms connected to the housing and which are disposed around the housing in spaced apart relationship towards the drive shaft end of the housing so as to use to bear against the bore of a pipe to be cleaned thereby to position the drive shaft coaxially of the pipe, a drive wheel, a drive motor operatively associated with the drive wheel for driving the apparatus through a pipe to be cleaned, a jacking arm for the drive wheel which extends away from the end of the housing remote from the drive shaft, and a jacking arm actuator operative for jacking the drive wheel into driving contact with the walls of a pipe to be cleaned.

10 Claims, 1 Drawing Figure

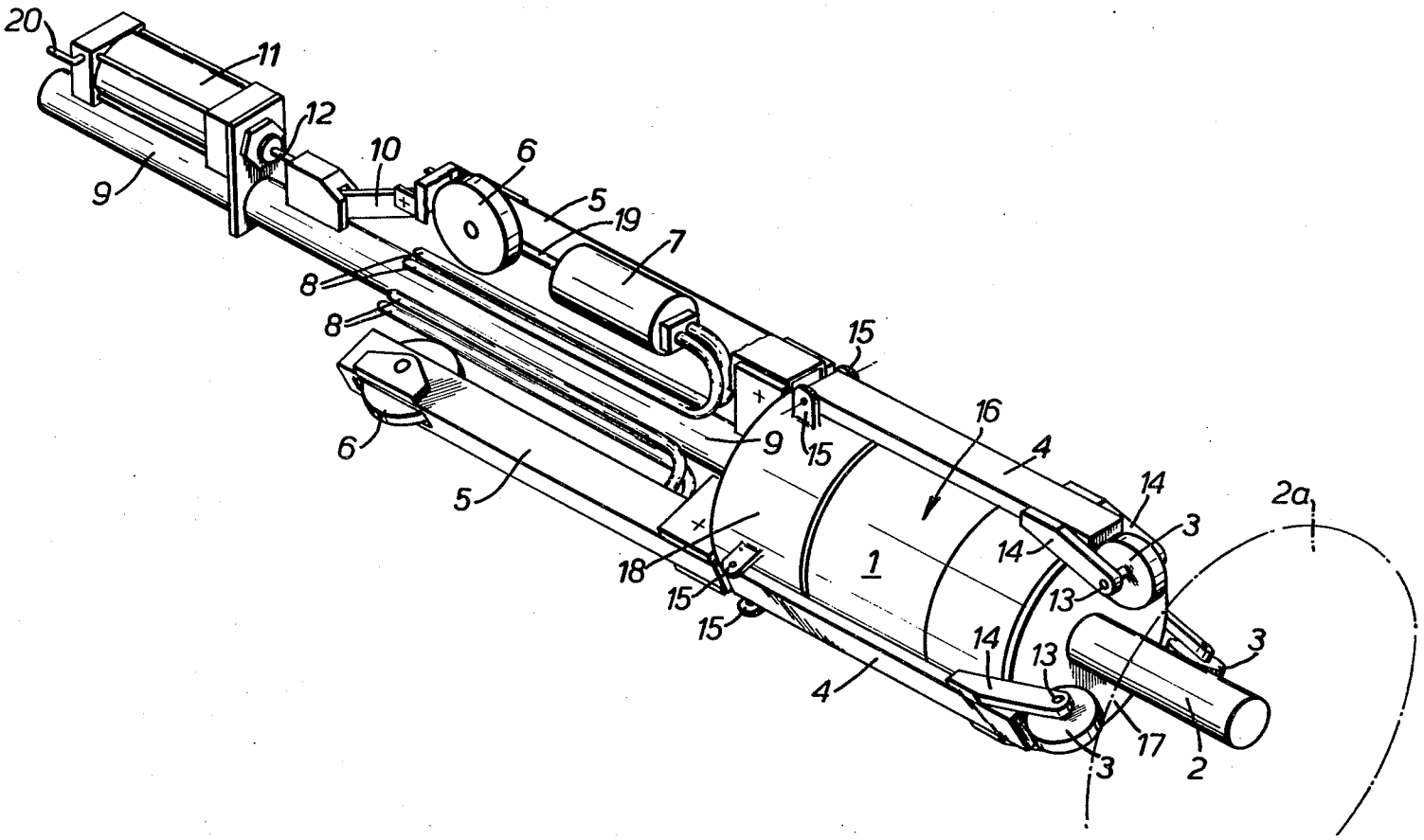
2a
3
2
3
14
17
3
13
13
4
14
14
16
1
15
15
4
9
15
15
18
7
19
5
6
5
10
8
8
6
12
11
9
20

PIPE CLEANING APPARATUS

This invention relates to pipe cleaning apparatus. The pipes to be cleaned, may be for example, pipes used for drilling, pipes used for carrying gas or petrochemicals such as oil, or pipes for well casings. Usually, the pipes will be made of steel but pipes of other materials could also be cleaned.

Hitherto, the cleaning of the bores of pipes to remove scale, weld flash, dirt, cement or other unwanted foreign substances which are not required has been carried out by manually operated equipment. It will be appreciated that the use of manually operated equipment is both time consuming and inefficient, particularly when it is required to clean relatively long lengths of pipe. For example, pipes in lengths of up to fifty feet or more often have to be cleaned in confined areas where sufficient space is often not available to push long rigid cleaning rods through the bores of the pipes. Also, the pipes are often stacked and they can be too high to be reached conveniently with the cleaning rods.

According to the present invention, apparatus for cleaning the bore of a pipe comprises a housing means, a cleaning tool motor mounted in the housing, means with its drive shaft extending from the housing means and adapted to receive a pipe cleaning tool rotatable with the drive shaft, at least three guide devices, support means connected to the housing means and supporting said guide devices and disposed around the housing means in spaced apart relationship towards the drive shaft end of the housing so as in use to bear against the bore of a pipe to be cleaned thereby to position the drive shaft coaxially of the pipe, drive wheel means, for advancing said housing means through a pipe, means for mounting said drive wheel means on said housing means, drive motor means operatively associated with the drive wheel means for driving the apparatus through a pipe to be cleaned, a jacking means for the drive wheel means which extends away from the end of the housing means remote from the drive shaft, and actuator means operative for actuating said jacking means for jacking the drive wheel means into driving contact with the wall of a pipe to be cleaned.

The cleaning tool motor, the drive motor means and the actuator means may all be operated pneumatically by compressed air fed to the apparatus via feedpipe means.

Conveniently the feedpipe means may comprise a main feedpipe which extends along the axis of the apparatus so as to feed the cleaning tool motor and so as to be coaxial with a pipe to be cleaned.

The cleaning tool motor, the drive motor means and the actuator means can also be hydraulically or electrically operated if desired.

Preferably, the guide devices are guide wheels but sliding guide blocks may also be employed.

The drive wheel means may comprise three drive wheels.

The drive motor means will usually be a separate air motor for each drive wheel, each air motor being arranged to be fed with compressed air from the feedpipe means.

When three drive wheels are employed, there is preferably provided an automatically controllable jacking arm for one of the drive wheels and then the remaining drive wheels are mounted on manually adjustable arms.

The manually adjustable arms may be adjusted by screw threaded members attached to the arms.

The automatically controllable jacking arm may be operatively coupled to actuator means formed by a pneumatically controlled actuator, the pneumatically controlled actuator being fed from the feedpipe means.

The pneumatically controlled actuator may comprise a cylinder within which a drive piston is enclosed and arranged so as to drive through mechanical linkages the jacking arm, responsively to the application of compressed air to the cylinder which is fed thereto via the feedpipe means.

Return of the jacking arm to a position whereat the drive wheels are disengaged from driving engagement with the walls of a pipe to be cleaned may be effected by spring biasing means.

Alternatively, the pneumatically controlled actuator may be double action actuator which can be driven in reverse to move the jacking arm inwardly.

An embodiment of the present invention will now be described solely by way of example and with reference to the accompanying drawing which is a generally schematic perspective view of pipe cleaning apparatus.

Referring now to the drawing, the pipe cleaning apparatus comprises a cleaning tool motor 1 having an outer casing or housing 16 from one end 17 of which a drive shaft 2 of circular cross section projects. The drive shaft 2 is normally fitted at one end remote from the motor 1, with any suitable connecting means such for example as a crows foot coupling (not shown), by means of which a cleaning tool (shown schematically as cleaning tool 2*a*) may be securely fitted at the end of the drive shaft 2 remote from the motor 1. The cleaning tool 2*a* may take any conventional form and will be selected in accordance with the type of cleaning job to be carried out. Thus, for example, the cleaning tool may have cutting teeth, arms with cutters, chains or metal block knocking heads. Spaced around the end 17 of the housing 16 are three guide devices in the form of guide wheels 3. The guide wheels 3 are disposed radially with respect to the drive shaft 2 so as to bear against the walls of a pipe to be cleaned. The guide wheels 3 are mounted on spindles 13. The spindles 13 are journaled for rotation in and supported by arms 14. The arms 14 form part of mechanical linkages 4 which are hinged at an end 18 of the housing 16 in hinge lugs 15 secured to the housing 16. To enable the pipe cleaning apparatus to be used with various sizes of pipe, the guide wheels 3 are manually jacked outwardly or inwardly by means of screw threaded members (not shown) extending from the guide wheel 3 and arm 14 ends of the mechanical linkages 4 to the housing 16 of the motor 1. When the guide wheels 3 are in the correct position, the screw threaded members are locked in position.

Arranged adjacent the end 18 of the motor housing, are three jacking arms 5. The jacking arms 5 are equally spaced apart and the drive wheels 6 are mounted on the jacking arms 5. The drive wheels 6 are disposed radially so as to engage in driving connection with the inside surface of a pipe to be cleaned. Each drive wheel 6 has operatively associated with it, its own pneumatic motor 7. Each pneumatic motor 7 drives its drive wheel 6 through a rotatable shaft 19 and a crown wheel and piston (not shown). In the drawing, only one pneumatic motor 7 is shown for simplicity of illustration. The pneumatic motors 7 are fed with compressed air via pipes 8 to provide driving force for the drive wheels 6, whereby the pipe cleaning apparatus can be driven through the pipe to be cleaned. Compressed air for the cleaning tool motor 1 is provided by a coaxially arranged feedpipe 9 which extends along the longitudinal axis of the pipe cleaning apparatus.

In order to bring the drive wheels 6 into intimate driving contact with the inside surface of a pipe to be cleaned, the uppermost of the jacking arms 5 as shown in the drawing, is coupled through a mechanical linkage 10 to a pneumatically controlled jacking arm actuator means which takes the form of an air jack 11. The air jack 11 has an output piston shaft 12 connected to drive the jacking arm 5 via the mechanical linkage 10, radially inwardly and outwardly as desired. The other two jacking arms 5 are manually jacked inwardly or outwardly to the approximate inside diameter of the pipe to be cleaned and they are then fixed in position. The uppermost jacking arm 5 can then be raised as desired, to cause the pipe cleaning apparatus to sit coaxially in the pipe so that all of the drive wheels 6 engage with the inside surface of the pipe to be cleaned. The uppermost jacking arm 5 is lowered in order to disengage the drive wheels 6 from the inside surface of the pipe, thus enabling the pipe cleaning apparatus easily to be removed from the cleaned pipe.

Thus in operation, after the pipe cleaning apparatus has been loaded into a pipe to be cleaned, compressed air is supplied to the pipes 8, the pipe 9 and a pipe 20 which feeds the air jack 11. The pipes 8, 9, 20 are fed via control valves (not shown) so that the drive shaft 2, the drive wheels 6 and the uppermost jacking arm 5 can be operated independently if desired. Having introduced the pipe cleaning apparatus into a pipe to be cleaned, the cleaning motor 1 is energised so that the cleaning tool 2*a* attached to the shaft 2 rotates and proceeds to clean the inside surface of the pipe. Whilst this operation is in progress, the air motors 7 are energised so that the drive wheels 6 rotate to drive the pipe cleaning apparatus at a uniform speed along the pipe whereby the whole length of the pipe is cleaned progressively. Whilst the cleaning procedure is in progress and the pipe cleaning apparatus is being driven along the pipe, the drive wheels 6 are maintained in driving contact with the inside surface of the pipe by the air jack 11 which operates through the mechanical linkages 10 to force the uppermost of the drive wheels 6 into driving contact with the pipe. The other two drive wheels 6 are thereby automatically centralised so as to make the required driving contact as described above.

It will be readily appreciated that the size of the pipe cleaning apparatus is determined by the size of the pipe to be cleaned and that a wide variation in pipe sizes is possible.

By utilising pipe cleaning apparatus as hereinbefore decribed, the tedious manual procedure hitherto utilised is avoided and efficient quick pipe cleaning is facilitated. The pipe cleaning apparatus can proceed along the pipe at a steady speed whereas with manual cleaning, the cleaning speed is often erratic due to the fact that rigid cleaning rods are being pushed through the pipes by hand.

Control of the pipe cleaning apparatus is advantageously effected from a control console remote from the pipe cleaning apparatus. The control console may have a control valve for the air jack 11, a pressure regulator for controlling the air pressure for the air jack 11, a control valve for the cleaning tool 2*a*, and a control valve which is connected to all three motors 7 and which is a directional valve used for controlling the direction of operation of the motors 7 depending upon whether the pipe cleaning apparatus is required to go into or be withdrawn from a pipe. The control valve for the three motors 7 also has an OFF position for turning the motors 7 off. There is also a pressure regulator for the control valve for the three motors 7, by means of which the power developed by the motors 7 can be controlled.

I claim:

1. Apparatus for cleaning the bore of a pipe comprising: a housing means, a cleaning tool motor mounted in said housing means with its drive shaft extending from the housing means and adapted to receive a pipe cleaning tool rotatable with the drive shaft, at least three guide devices, support means connected to the housing means and supporting said guide devices and disposed around the housing means in spaced apart relationship towards the drive shaft end of the housing so as in use to bear against the bore of a pipe to be cleaned thereby to position the drive shaft coaxially of the pipe, drive wheel means for advancing said housing means through a pipe, means for mounting said drive wheel means on said housing means, drive motor means operatively associated with the drive wheel means for driving the apparatus through a pipe to be cleaned, a jacking means for the drive wheel means which extends away from the end of the housing means remote from the drive shaft, and actuator means operative for actuating said jacking means for jacking the drive wheel means into driving contact with the wall of a pipe to be cleaned.

2. Apparatus as claimed in claim 1 wherein the cleaning tool motor, the drive motor means and the actuator means are arranged to be operated pneumatically by compressed air fed to the apparatus via feedpipe means.

3. Apparatus as claimed in claim 2 wherein the feedpipe means comprises a main feedpipe which extends along the longitudinal axis of the apparatus so as to feed the cleaning tool motor.

4. Apparatus as claimed in claim 1, claim 2, or claim 3 wherein the guide devices are guide wheels.

5. Apparatus as claimed in claim 1 wherein the drive wheel means comprises three drive wheels.

6. Apparatus as claimed in claim 5 wherein the drive motor means comprises separate air motors, one for each drive wheel.

7. Apparatus as claimed in claim 5 wherein the jacking means is a controllable jacking arm for one of the drive wheels, the remaining drive wheels being mounted on manually adjustable arms.

8. Apparatus as claimed in claim 7 wherein the controllable jacking arm is operatively coupled to actuator means formed by a pneumatically controlled actuator, the pneumatically controlled actuator being fed from a feed pipe means.

9. Apparatus as claimed in claim 8 wherein the pneumatically controlled actuator comprises a cylinder within which a drive piston is enclosed and arranged so as to drive through mechanical linkages the jacking arm, responsively to the application of compressed air to the cylinder which is fed thereto via the feed pipe means.

10. Apparatus as claimed in claim 9 wherein the pneumatically controlled actuator is a double action actuator which is drivable in reverse so as to move the jacking arm inwardly.

* * * * *